US005424554A

United States Patent [19]

Marran et al.

[11] Patent Number: 5,424,554

[45] Date of Patent: Jun. 13, 1995

[54] OIL-BURNER, FLAME-INTENSITY, MONITORING SYSTEM AND METHOD OF OPERATION WITH AN OUT OF RANGE SIGNAL DISCRIMINATOR

[75] Inventors: John D. Marran, Califon, N.J.; Stanley Miller, Rocky Point, N.Y.

[73] Assignee: Energy Kenitics, Inc., Lebanon, N.J.

[21] Appl. No.: 216,147

[22] Filed: Mar. 22, 1994

[51] Int. Cl.[6] ..... G01J 1/10

[52] U.S. Cl. ..... 250/554; 340/578

[58] Field of Search ..... 250/554, 239; 356/226, 356/218, 438; 340/577, 578

[56] References Cited

U.S. PATENT DOCUMENTS 4,904,986 2/1990 Pinckaers ..... 250/554

5,365,223 11/1994 Sigafus ..... 340/578

*Primary Examiner*—David C. Nelms

*Assistant Examiner*—Que T. Le

*Attorney, Agent, or Firm*—Paul C. Scifo

[57] ABSTRACT

Improved apparatus and method for selectively monitoring the light intensity emitted from an oil-burner flame for purposes of determining when the burner is in need of preventative maintenance. The apparatus features a monitoring system including: a sensor for detecting burner, flame-light intensity; a comparator for comparing the light intensity sensed to predetermined upper and lower limits; a display for indicating whether the burner is operating acceptably or whether it requires maintenance; and a discriminator for selectively coupling out-of-range, intensity indications representative of a need for maintenance to the display. The discriminator includes measurement-threshold circuitry for determining whether the burner has successfully ignited and whether the flame generated has been sustained long enough to assure thermal stabilization. Additionally, the discriminator includes gating circuitry for passing out-of-range, intensity measurements to the display elements only when predetermined, measurement-threshold conditions have been satisfied. The method features steps for: continuously sensing burner, flame-light intensity; comparing sensed, flame-light intensity to predetermined range limits; and selectively coupling out-of-range, intensity indications to a display for indicating the need for burner maintenance.

18 Claims, 5 Drawing Sheets

OIL-BURNER, FLAME-INTENSITY, MONITORING SYSTEM AND METHOD OF OPERATION WITH AN OUT OF RANGE SIGNAL DISCRIMINATOR

BACKGROUND OF INVENTION

1. Field of Invention

This invention concerns apparatus and method for selectively monitoring the light intensity emitted from an oil-burner flame for purposes of determining when the burner is in need of preventative maintenance. More specifically, the apparatus aspect of the invention features: a sensor for sensing burner, flame-light intensity; a comparitor for tracking light-intensity drift over time relative to predetermined upper and lower limits; a display for indicating the need for burner maintenance; and a discriminator for selectively coupling out-of-range, intensity indications to the display. The method aspect of the invention features steps for: continuously sensing burner, flame-light intensity; comparing sensed, flame-light intensity to predetermined range limits; and selectively coupling out-of-range, intensity indications to a display for indicating the need for burner maintenance.

2. Prior Art

For some time now, the oil-heating industry and government have been working to further improve the efficiency of oil heating for both residential and commercial applications. While oil heating has shown itself to be cost efficient, reliable and safe, thus providing substantial value to its user, proponents of oil heating have sought to further increase its attractiveness by reducing wasteful oil consumption and increasing cleanliness of combustion.

In this regard, researchers have found that one of the principal indicators of combustion inefficiency and waste is smoke. As might be expected, production of smoke by the burner flame indicates the fuel being supplied to the system is not being completely combusted, with the result that less heat is being generated per pound of fuel consumed. Further, as smoke is produced, it accumulates on the heating system components; as for example, the system heat exchanger which, depending on the system type, transfers heat from the burner flame to either hot water or hot air. Accordingly, what heat the inefficient combustion is able to produce is less efficiently transferred from the flame, thereby, additionally diminishing the overall, energy-conversion efficiency of the heating system.

While in most cases the conditions that cause combustion inefficiency and associated smoke symptoms; for example, improper burner mixture settings, fouled oil injector nozzles or air intake openings, etc., can be readily corrected with a simple burner service call, most such situations go wholly unnoticed. Typically, system operators, usually home owners, are unaware of burner status and have occasion to call for service only when operation has so deteriorated that the burner stops working altogether. The consequence is that where home owners fail to recognize the condition of their heating systems, not only will they be penalized with the unnecessary costs of inefficient fuel consumption, but also, they will have to bear the expense of repairs for correcting soot-fouled equipment that results from inefficient operation, an expense which can add substantially to heating bills.

In the late 1980's researchers in the oil heating industry working under Federal sponsorship recognized this problem and proposed a simple, flame-quality monitor for indicating to home owners when burner operation had so deteriorated as to require maintenance for corrective action. Regrettably, however, while the system proposed suggested promise for at least diminishing the severity of the problem, it was found susceptible to practical limitations which rendered its operation commercially unattractive.

More specifically, Butcher et al. in U.S. Pat. No. 5,126,721 describe a flame-quality monitor for use in common, home-heating equipment. As noted by Butcher et al., burner deterioration resulting from improper mixture settings as well as other causes could be readily detected by: sensing flame light intensity in the visible band with a low-cost, cadmium-sulfide (CAD) photocell; comparing the sensed flame intensity to reference intensities using comparator circuitry; and noting the need for a service call with an indicator lamp provided at a display panel when the flame intensity moved out of an acceptable range. In accordance with the Butcher et al. design, the CAD photocell is mounted at the burner head, proximate the burner flame and supplies signals corresponding to the flame-light intensity to the electrical-comparator circuit located in a monitor box mounted on the burner housing. The comparator circuitry, in turn, provides an output signal to an indicator lamp at the display panel on the monitor box when the flame-light intensity goes above or below preset limits.

As noted, however, though the Butcher et al. monitor appeared to be a convenient, low cost approach to the problem of notifying home owners of degraded burner conditions, it was found susceptible to practical problems. Specifically, because of its simplistic design, the Butcher et al. monitor was found prone to giving false indications of burner degradation. As a result, when faced with an indication for service, users would be uncertain as to whether the monitor was correct or not. In effect, due to the potential for error, the monitor's credibility was undermined, and its commercial usefulness compromised.

The cause of the problem arises from the Butcher et al. approach to monitoring burner operation. Particularly, for the sake of simplicity, the Butcher et al. monitor does not discriminate between burner firings. Rather, it senses flame intensity each and every time the burner is activated. The difficulty with this is that in a conventional, home-heating system, the burner is repeatedly turned on and off for both heating and so called "standby" cycles. In standby cycle, however, the burner is on for only a short time to merely compensate for system losses, and accordingly, the system typically does not attain the operating temperature realized in the seasonally variably, but nonetheless, much longer space and/or water heating cycles. As a result, flame intensity measurements made during standby and short heating cycles are unreliable and susceptible of inaccurately indicating burner status.

As a result, experience has shown, that where no effort is made to discriminate between burner firings, a significant number of need-for-maintenance indications will be spurious. Accordingly, potential users; e.g., home owners who might purchase the monitor, are likely to encounter uncertainty and dissatisfaction on finding, after having incurred the cost of a service call, that the monitor indication was wrong.

SUMMARY OF INVENTION

Accordingly, it is an object of present invention to provide an improved, oil-burner, flame-intensity, monitoring system and method of operation capable of indicating when the burner is no longer operating within prescribe limits.

Further, it is an object of the present invention to provide an improved, oil-burner, flame-intensity, monitoring system and method of operation capable of limiting spurious indication of need for maintenance arising from system warm-up effects.

Still further, it is an object of the present invention to provide an improved, oil-burner, flame-intensity monitoring system and method of operation capable of assuring the burner is operating before out-of-range measurements are accepted.

Further still, it is an object of the present invention to provide an improved, oil-burner, flame-intensity monitoring system and method of operation capable of assuring the burner is stabilized before out-of-range measurements are accepted.

Yet further, it is an object of the present invention to provide an improved, oil-burner, flame-intensity monitoring system and method of operation capable of discriminating between burner standby cycles and heating cycles.

Further yet, it is an object of the present invention to provide an improved oil-burner, flame-intensity monitoring system and method of operation that are low cost and simple to use.

Briefly, the improved oil burner flame intensity monitoring system and method of operation in accordance with this invention realizes the above-noted and other objectives by selectively monitoring light intensity emitted from an oil-burner flame for purposes of more reliably determining when the burner is in need of preventative maintenance.

In preferred form, the apparatus aspect of the invention features a monitoring system including: sensor elements for detecting burner, flame-light intensity; comparator elements for comparing the light intensity sensed to predetermined upper and lower limits; display elements for indicating whether the burner is operating acceptably or whether it requires maintenance; and discriminator elements for selectively coupling out-of-range, intensity indications representative of a need for maintenance to the display elements. More specifically, the discriminator elements include measurement-threshold circuitry for determining whether the burner has successfully ignited and whether the flame generated has been sustained for a predetermined time interval sufficient to assure that substantial thermal stabilization of the flame and burner. Additionally, the discriminator elements include gating circuitry responsive to the measurement-threshold circuitry and the flame-light, intensity-comparitor elements for passing out-of-range, intensity measurements to the display elements only when predetermined, measurement-threshold conditions have been satisfied.

In preferred form, the system sensor elements include a cadmium-sulfide photocell mounted at the burner head and a biasing network provided in a system-circuit box located at the burner external housing for sensing the light intensity emitted by the burner flame. Further, the sensor elements are electrically connected to the comparitor elements and the discriminator elements also provided at the system box. Still further, the comparitor elements include a filtering and amplifying stage and a flame-intensity window comparitor, while the discriminator elements include measurement-threshold, and gating circuitry, the measurement-threshold circuitry comprising a flame comparitor, and a fault-indication enabler, and the gating circuitry comprising a fault-detection gate. In accord with the invention, the measurement-threshold circuitry and the intensity-comparitor elements are electrically connected at the discriminator-gating circuitry for selectively coupling out-of-range, flame-intensity measurements to the display elements also provided at the system-circuit box.

Preferably, the display elements include indicator drivers and indicators for both normal and need-for-maintenance status. Additionally, the display elements include a manually-resetable, latch circuit connected to the need-for-maintenance driver and indicator so that indications of need for maintenance are required to be manually cleared to assure recognition by the burner operator.

Further, the display elements also include a panel provided at the system-circuit box featuring lamps which indicate whether the burner is within prescribed operating limits; e.g., a green light, or whether operation has gone out of the normal operating range requiring correction by a service technician; e.g., red or yellow light. Explanatory indicia may also be provided at the display to support interpretation of the lamp indications.

Also in preferred form, the system, display elements optionally include a fault-indication takeoff for enabling fault indications to be; for example, locally recorded and/or communicated to a date-receiving site such as a burner-service company and/or activate an alarm.

The method aspect of the invention in preferred form features steps for: sensing burner, flame-light intensity; comparing sensed flame-light intensity to predetermined range limits; selectively coupling out-of-range, intensity measurements to a display; and indicating the need for burner maintenance. More specifically, in preferred form, the method steps for selectively coupling out-of-range measurements to the maintenance indicator includes steps for discriminating the flame intensity measurements by comparing sensed flame intensity to a flame-ignition reference for generating an ignition-verification signal, and thereafter, steps for monitoring the ignition-verification signal over a predetermined time interval and where the verification signal is sustained for the interval, generating an indication-enabling signal. Still further in preferred form, the discriminating procedures includes steps for indicating out-of-range, flame intensities only when an out-of-range measurement and an indication-enabling signal are present.

Yet further, in preferred form, the method aspect of the invention optionally includes steps for either locally recording indications of need for burner maintenance and/or communicating such indications to a burner-service company, as for example, by modem and/or activate a local alarm. Still further, the method features steps for storing the indications of need for maintenance and requiring such stored indications be physically cleared by an operator to assure recognition of burner condition.

BRIEF DESCRIPTION OF THE DRAWINGS

The above and other features of the invention may be understood on review of the following detailed description, read in connection with the accompanying figures in which.

DESCRIPTION OF THE PREFERRED EMBODIMENT

As noted above, researchers in the oil-heating industry have found that a principal indicator of combustion inefficiency and contributor to waste in oil-heating systems is smoke. Production of smoke by the burner flame indicates that fuel being supplied to the system is not being completely combusted. As a result, less energy for heating is generated per pound of fuel consumed. Additionally, as the burner continues to produce smoke, soot accumulates on the heating system components; such as the system heat exchanger, which impedes the transfer of energy from the burner flame to the heating medium; for example, hot water or hot air. As a result, what heat the inefficient combustion is able to produce is less efficiently transferred from the flame, thus further degrading overall energy-conversion efficiency.

As also noted, in most cases the conditions that cause combustion inefficiency and associated smoke symptoms; for example, improper burner mixture settings, fouled oil injector nozzles, fouled air intake openings, etc., can be readily corrected with a simple service call. Regrettably, however, the burner operator, typically a home owner, is unaware of system conditions and will call for service only when the burner conditions have so deteriorated that either the burner stops operating altogether, or some other major difficulties appears; as for example, where smoke backs up into the house because of a soot-clogged exhaust. The consequence is not only will home owners be penalized by unnecessary costs associated with inefficient fuel consumption, but also, their repair expenses for correcting fouled equipment arising from inefficient operation will substantially adds to their already unduly high heating bills.

It was also pointed out above that in the past, workers in the oil-heating field recognized this problem and proposed a simple monitor for tracking oil-burner flame quality. In accordance with the design, burner flame-light intensity is monitored to estimate burner status, and where flame-light intensity is found to have so deteriorated as to suggest the need for maintenance, a visual notification is supplied to the home owner by means of a light indicator provided at a display panel.

Figure 2:
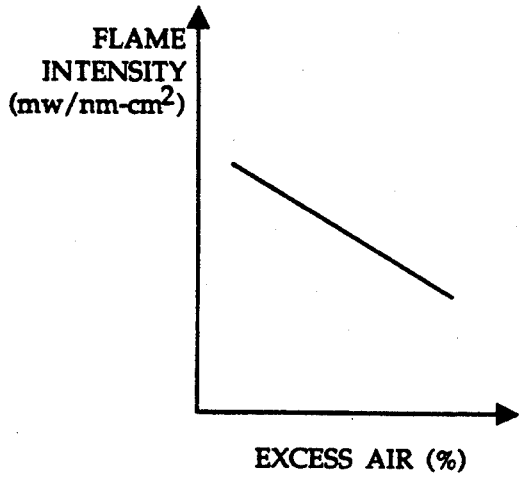
FIG. 2 is a generalized plot of oil-burner, flame intensity versus excess air.

More specifically, Butcher et al. in U.S. Pat. No. 5,126,721 noted, as had been known in the industry for some time and as shown in FIG. 2 herein, that as the amount of excess air; i.e., air in excess of that necessary to support combustion, is increased beyond the industry recognized optimal setting; i.e., approximately 15% the amount of smoke the burner produces increases, while the burner, flame-light intensity in the visible range decreases. It has also been widely known, though not reported in the Butcher et al. patent, that smoke production additionally increases and light intensity in the visible range decreases as excess air is diminished below the optimal 15% excess air setting; i.e., from approximately 15% to 0%, with combustion terminating below 0%.

Given the fact that emitted flame-light intensity in the visible range was proportional to the difference between the optimal, burner, excess-air settings and the actual setting; i.e., less light intensity being emitted as the actual, excess-air setting diverges from the optimal setting, Butcher et al. proposed to monitor light intensity as an indicator of excess-air setting and flame quality; i.e., smoke condition.

Figure 3:
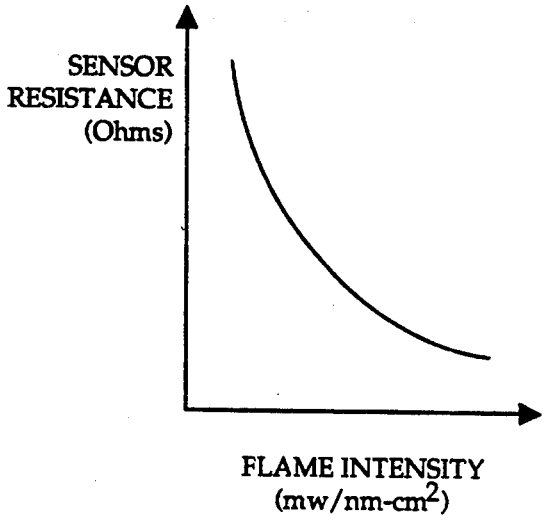
FIG. 3 is generalized plot of resistance for a cadmium-sulfide photocell versus oil-burner, flame intensity.
Figure 4:
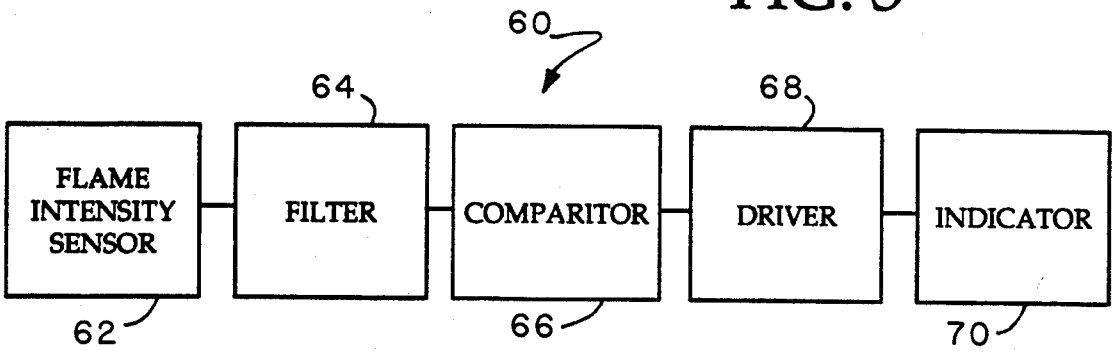
FIG. 4 is a block diagram of a prior-art, oil-burner, flame-quality monitor.

To sense emitted flame light, Butcher et al. proposed to use a conventional, low-cost cadmium-sulfide (CAD) photocell. As shown in FIG. 3, for a conventional CAD photocell, resistance decreases as the sensed light intensity increases. Further, Butcher et al. proposed to use the CAD photocell in a simple monitor 60 shown in block form in FIG. 4. Particularly, Butcher et al. proposed to use photocell sensor 62 to convert burner, flame-light intensity into a voltage signal, to thereafter supply the photocell output signal to filter 64 for dampening, and to subsequently feed the dampened, photocell signal to comparitor 66 to compare the photocell intensity signal to a predetermined range of acceptable light-intensity levels. Still further, Butcher et al. proposed, simply, to take any indication of flame intensity outside the predefined limits set at comparitor 66, and supply that result to driver 68 for activating indicator 70, which, in turn, would display a need for a maintenance call. Butcher et al. also proposed that the monitor include other indicators, not shown, for noting the burner flame quality was within acceptable limits.

Unfortunately, however, and as previously noted, the Butcher et al. monitor is susceptible to practical problems. Because of its simplistic design, it is inclined to give false indications of burner degradation and need for service. The cause of this as described above lies in the Butcher et al. approach to monitoring burner operation. The Butcher et al. monitor does not discriminate between burner firings. Rather, it senses flame-light intensity each and every time the burner is activated. The difficulty, however, is that in a conventional, home-heating system, the burner is repeatedly turned on and off for both heating and so called "standby" cycles. In standby cycle, however, the burner is on for only a short period of time to merely compensate for system losses, and accordingly, typically does not attain the operating temperature realized in the seasonally variable, but, nonetheless, much longer heating cycles when the burner is called upon to deliver energy for space and/or water heating.

Further, because system temperatures are lower during the standby cycles, the burner element surrounding the flame not having had a chance to come up to a stabilization temperature, the light intensities radiated by the burner flame are likewise lower and irregular. Accordingly, the possibility exists, that though the burner is properly set for operation at the stabilization temperature, the monitor will give an indication of improper operation during standby cycles or even short heating cycles.

Though, as suggested in the their patent, Butcher et al. were aware of this problem, they apparently were of the view that since a burner would be subjected to a great number of cycles in a season; e.g., 6,000 to 10,000 in total, this problem would either be minimal or dominated by operation during heating cycles. Accordingly, Butcher et al. continued to teach that all burner firing should be measured, and on any occasion of flame intensity being out of range, a need for a maintenance should be indicated.

Experience has shown, however, that the consequence of this approach is that a significant number of maintenance indications presented by such monitors will be in error. As a result, home owners using such monitors are likely to encounter uncertainty on finding need-for-maintenance indications, the home owners wondering whether they should incur the cost of service calls to find out if the monitor indications are correct or not. While system accuracy in such monitors might be helped by expanding the range of permissible upper and lower flame intensities in an effort to prevent standby and short heating cycles for triggering spurious maintenance indications, the consequence of broadening the acceptable flame intensity limits, however, is to accept higher levels of smoke before noting the need for maintenance. But, as will be appreciated, by accepting higher levels of smoke, users are again subjected to higher levels of inefficient fuel consumption and soot buildup, thus undercutting the benefit the monitor was originally intended to provide.

The improved oil-burner, flame-intensity monitoring system and method of operation in accordance with the present invention, however, overcomes the shortcoming of the prior art design. Particularly, the apparatus and method of the present invention accomplishes this by not accepting all measurements of burner firings as candidates for display as has been taught by the prior art. Rather, the apparatus and method of the present invention discriminates between burner firings based on duration, and elect to accept only measurements of firings that have endured long enough to make certain thermal equilibrium of the burner and flame has been substantially attained. In this way assurance can be provided that the sensed, flame-light intensities measured reflect actual conditions at the burner. To achieve this, the apparatus and method of the present invention selectively couple out-of-range, light-intensity measurements to the system display elements. The apparatus and method do this by discriminating among burner firings based on time, and thereafter, by only enabling indications when the out-of-range, light-intensity conditions and discrimination conditions have been satisfied.

Figure 1:
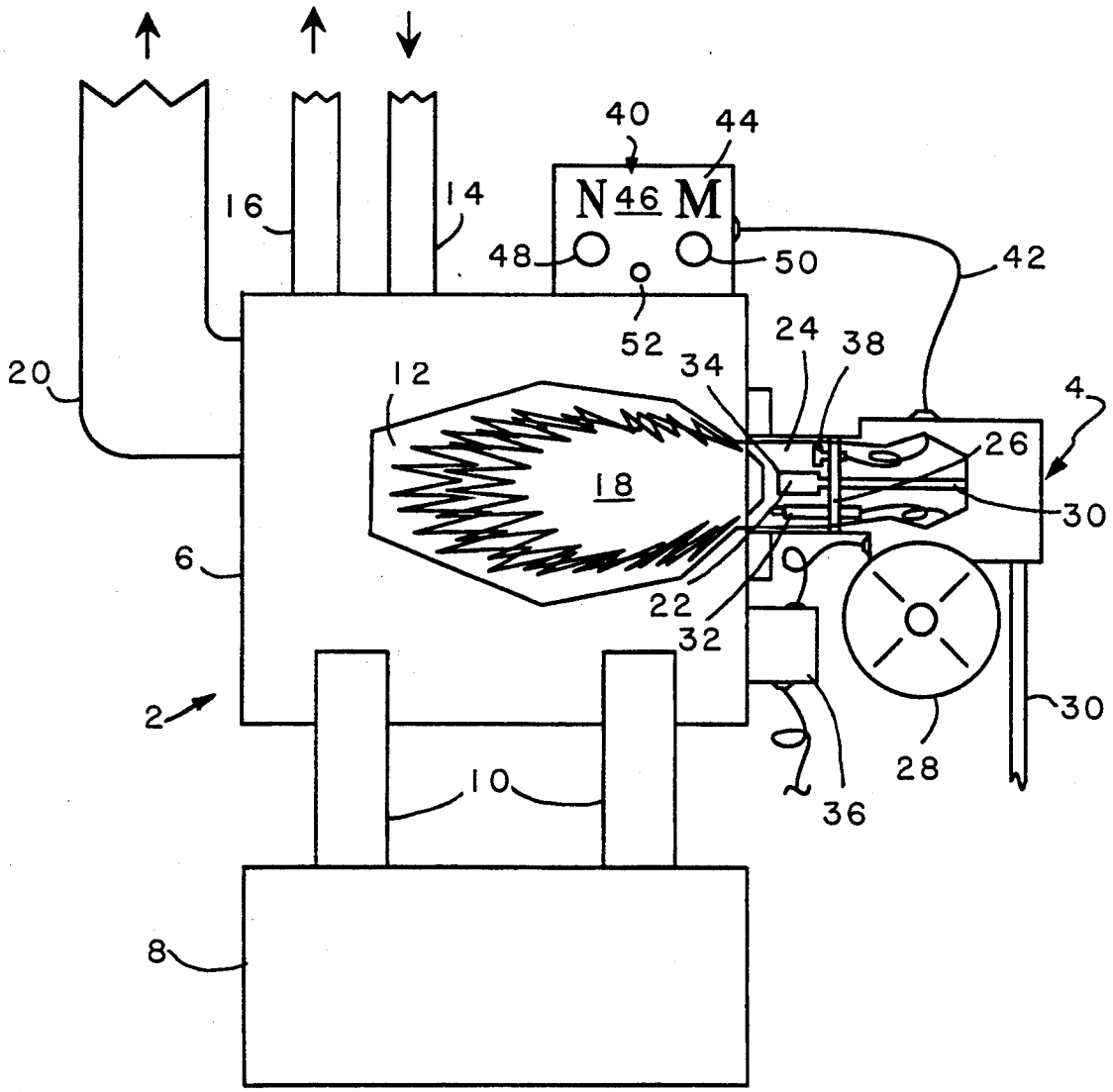
FIG. 1 is a schematic, side-elevation view partially broken away of an oil-burner, heating system including the improved flame intensity monitoring system in accord with the invention.

With regard to the apparatus aspect, the improved monitoring system 1 of the present invention is shown in FIG. 1 connected to a convention oil-burner heating system 2. As seen in FIG. 1, heating system 2 is presented in simplified form for ease of understanding and includes a burner 4 mounted to a furnace 6 which is itself mounted on a base 8 by means of support legs 10. As shown, system 2 is of the hot-water type and includes a cylindrical boiler and heat exchanger 12 located internally of furnace 6 and connected to system hot-water inlet 14 and outlet 16. Still further, system 2 is seen to include a flame 18 supported by burner 4 and located centrally of furnace 6 and boiler 12. A flue 20 is connected to furnace 6 in conventional fashion to carry off exhaust from flame 18.

As shown in FIG. 1, burner 4 is partially broken away and is seen to include in conventional fashion oil nozzle 22 axially located at burner head 24 by support 26 for atomizing fuel supplied by pump 28 and line 30, line 30 being connected to a fuel-storage tank not shown. In accordance with usual practice, burner 4 also includes an electrical igniter 32 mounted at support 24 and located proximate nozzle outlet 34 for initiating combustion of the atomized fuel. In usual fashion, a controller 36 is electrically connected to fuel pump 28, igniter 32 and system thermostats, not shown, to initiate and support flame 18 for satisfying heating needs of the environment served.

Continuing with reference to FIG. 1, flame-light intensity monitoring system 1 is seen to include a cadmium-sulfide photocell 38 and a system-circuit box 40. As shown, photocell 38 is mounted internally of burner 4 in any convenient fashion; e.g., at support 28 proximate fuel nozzle 24. As will be appreciated, photocell 38 is located sufficiently close to flame 18 to permit faithful sensing of the emitted, flame-light intensity, but yet, displaced from; e.g., rearwardly of, fuel nozzle outlet 38 to avoid photocell fouling by atomized burner oil. Preferably, though not shown for the sake of simplicity, photocell 38 may be located behind support plate 26 relative to flame 18, arranged to sight the flame through a hole in the support plate to prevent photocell overheating. Additionally, photocell 38 is seen to be electrically connected to system-circuit box 40 by wiring 42, box 40 being conspicuously mounted at furnace 6.

As shown in FIG. 1, system-circuit box 40 includes a display 44 provided at one of the box faces. In preferred form, display 44 is in the form a panel 46 provided with indicator lamps 48 and 50, preferably, light emitting diode assemblies (LED's), for respectively denoting normal operation and need for maintenance. Preferably, panel 46 also includes indicia; e.g., "N", "M", for denoting the significance of the respective lamps. As will be appreciated, while for simplicity of use and low cost, display 44 has been implemented in a very basic form, other and more elaborate arrangements well known in the display art could also be used. Yet additionally, panel 46 is seen to further include a manual reset button 52 to permit an indication of need for maintenance to be manually cleared as will be more full described below.

As noted, monitoring system 1 is designed to selectively sense light intensity emitted from an oil-burner flame for purposes of more reliably determining when the burner is in need of preventative maintenance. To accomplish this, system 1 is design not to accept all burner firings as candidates for measurement as had been taught by the prior art. Rather, system 1 discriminates between burner firings based on duration, and elects to accept for consideration only those firings that have endured long enough to make certain substantial thermal equilibrium of the burner and flame has been attained.

Figure 7:
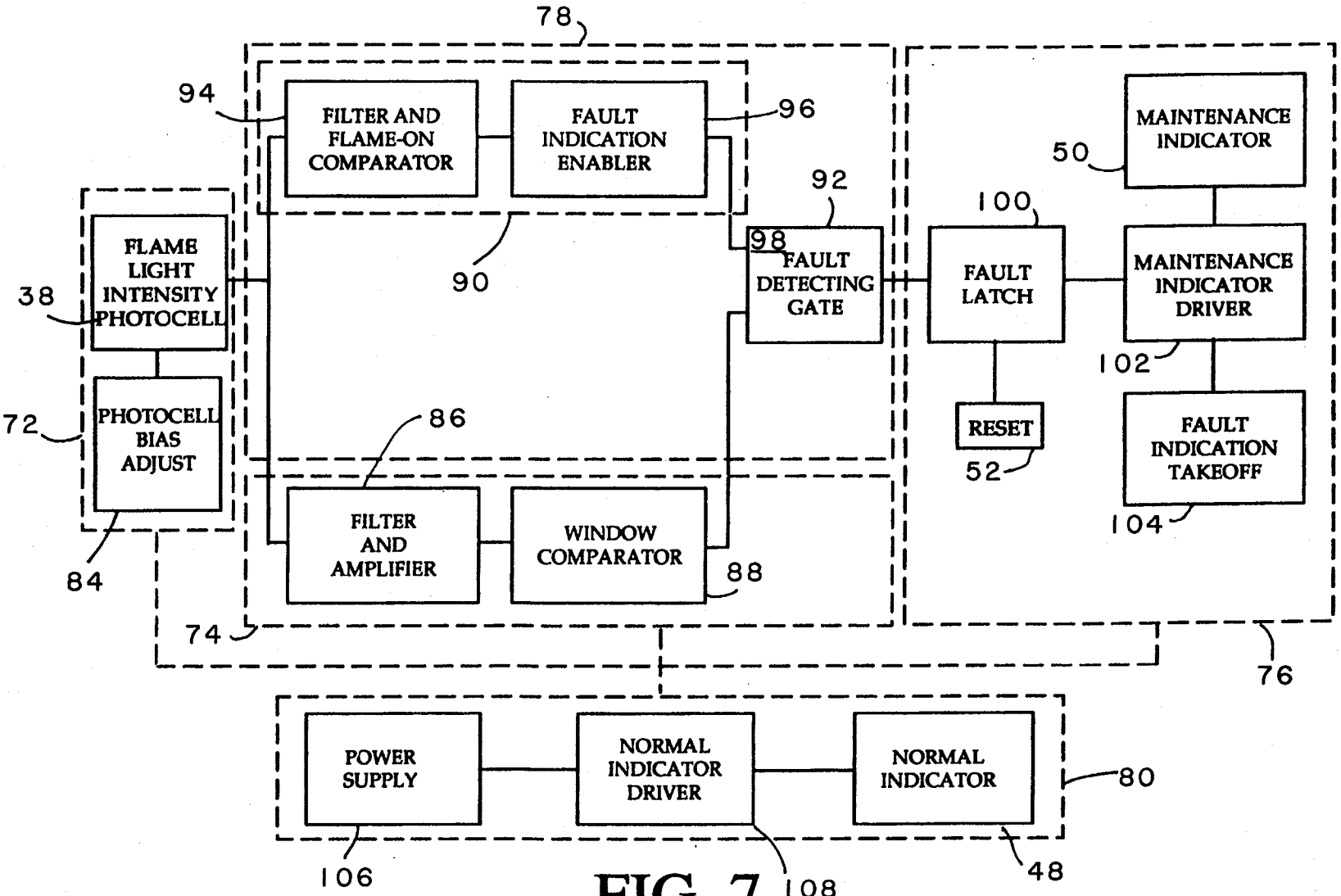
FIG. 7 is a block diagram of the improved oil-burner, flame intensity monitoring system in accord with the invention.

To better understand its organization, monitoring system 1 is presented in functional, block-diagram form in FIG. 7. As seen there, system 1 includes: sensor elements 72 for detecting burner flame-light intensity; comparitor elements 74 for comparing the sensed light intensity to predetermined upper and lower limits; display elements 76 for indicating the burner requires maintenance; and discriminator elements 78 for selectively coupling out-of-range intensity measurements indicative of a need for maintenance to the display elements 76. Yet further, system 1 also includes elements 80 for supplying the required power for system operation and indicating normal burner functioning.

As shown in FIG. 7, system, sensor elements 72 are seen to include cadmium-sulfide photocell 38 and biasing network 84. Further, comparator elements 74 include a filtering and amplifying stage 86, and a flame-intensity, window comparator 88. Continuing, discriminator elements 78 comprise measurement-threshold circuitry 90 and gating circuitry 92, measurement-threshold circuitry 90 including filter and flame-on comparator 94, and a fault-indication enabler 96, while gating circuitry 92 features fault-detection gate 98.

Still further, need-for-maintenance, display elements 76 are seen to include: fault latch 100, which in preferred form is manually resetable; maintenance-indicator driver 102; and maintenance indicator 50, which as noted above is preferably an LED assembly configured to provide a red or yellow light when activated. As also shown in FIG. 7, need-for-maintenance display elements 72 may optionally include a maintenance-indication takeoff 104, which preferably can take the form of a local printer, not shown, and/or a data communication element such as a modem, also not shown. Yet additionally, fault-indicator takeoff 104 may also be connected to a home alarm system; for example, an alarm bell or warning signal to indicate to the home owner that an out of range firing has been encountered.

Finally, system 1 is seen to yet further include elements 80 for supplying power to the system and indicating normal burner operation, elements 80 including power supply 106, normal-indicator driver 106 and normal-operation indicator 48. As noted above, normal indicator 48, for the sake of simplicity is a conventional LED assembly, configured to provide green light when activated.

As noted, in accordance with the invention, photocell 38 is located at burner 4, proximate flame 18, while the remainder of the system elements are provided at system-circuit box 40, elements within box 40 being electrically connected to photocell 38 by wiring 42 as best seen in FIG. 1.

Continuing with reference FIG. 7, the elements of system 1 are functionally connected such that photocell 38, as biased by network 84, feeds both comparator elements 74 and discriminator elements 78. Further, comparitor elements 74 and discriminator elements 78 in addition to being connected such that they simultaneously receive the same output from photocell 38, are also connected such that the output of window comparitor 88 and measurement-enabling circuitry 90 are supplied to fault detector gate 98. Accordingly, measurements of flame-light intensity outside the acceptable window; i.e., acceptable upper and lower flame-intensity limits, will be passed to need-for-service display elements 76 only where flame-light intensity signals from photocell 38 satisfy measurement-enabling circuitry 90; i.e., flame-on comparitor 94 and fault-indication enabler 96.

In this regard it is to be noted that flame-on comparitor 94 provides an output only when the light intensity signal from photocell 38 is sufficient to indicate burner flame 18 is in fact ignited. Further, fault-indication enabler 96 to which flame-on comparitor 94 is connected, provides an output only where the output signal-on comparitor 94 is sustained for a predetermined interval, which, in accordance with the invention is selected to assure the flame and burner have substantially reached thermal equilibrium, preferably, approximately five to seven minutes.

As described, the shortcoming of prior art light-intensity monitors is their proclivity for erroneously indicating need for maintenance. This proclivity arises from their inability to distinguish between short burner firings; e.g., standby cycles, and long burner firings; e.g., heating cycles. Since system temperatures are lower and irregular during short firing cycles, the burner and flame not having had a chance to reach stabilization, flame-light intensities are likewise lower and irregular. Accordingly, prior-art monitors tend to interpret the low-intensity irregular flame as being due to a faulty burner and, issue an indication of need for maintenance even that though the burner is properly set.

Figure 5:
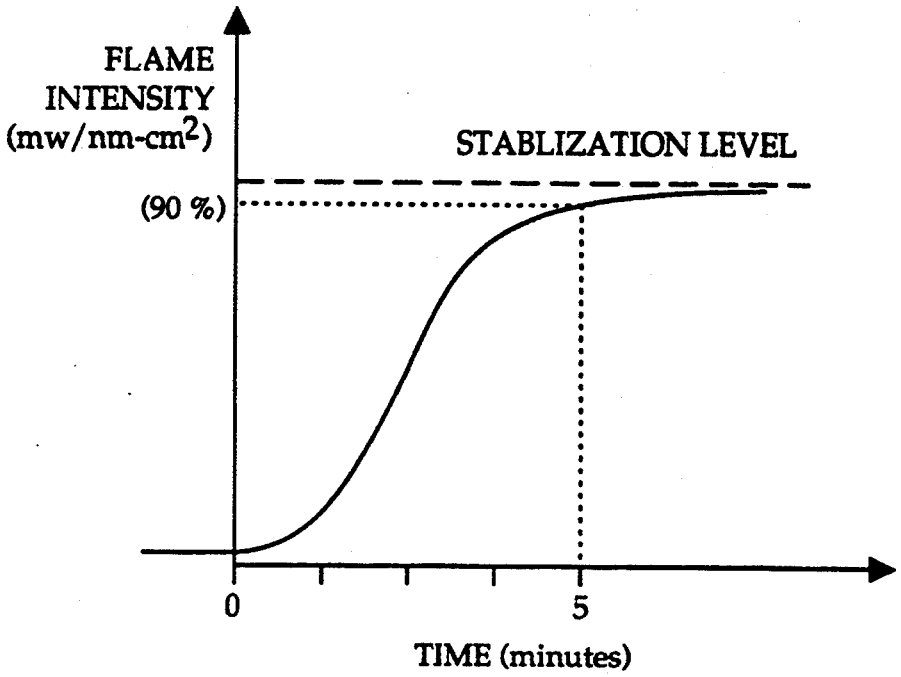
FIG. 5 is a generalized plot of oil-burner, flame-light intensity versus time which depicts burner and flame stabilization.

The present invention overcomes these shortcoming by discriminating between burner firings. Particularly, the system of the presents invention rejects short-duration, unreliable, burner firings by suppressing measurements of the flame-intensity relative to the established limits during an interval corresponding to flame stabilization. As shown in FIG. 5, burner flames typically have a relatively short, but, finite stabilization period over which the emitted light intensity rises exponentially to its final value. Accordingly, by suppressing indication of the out-of-range indications from window comparitor 88 during the defined stabilization interval, system 1 effectively avoids the potential for erroneous readings. In conventional home-heating system, this interval extends from approximately five to seven minutes. Therefore, in accord with the present invention, fault-indication enabler 96 will not provide a measurement-enabling signal to fault-detector gate 98 until flame-on comparitor 94 has sustained an indication of flame occurrence for the prescribed interval, which in preferred form, is determined by burner's characteristics which, in the case of conventional home-heating units, is from about five to seven minutes.

As will be appreciated by those skilled in the art, flame-on comparitor 94 in addition to cooperating with indication enabler 96 as described, also provides further protection against erroneous readings. Specifically, by requiring assurance of a flame at the burner, out-of-range measurement activity at window comparitor 88 in the absence of a flame that could otherwise lead to erroneous calls for maintenance if expiration of a prescribed interval alone were relied on for enablement is avoided.

As a still further feature of system 1, indication enabler 96 successively provides measurement-enabling signals to fault-detector gate 98 to permit continuing analysis of long-duration burner firings. More specifically, following initial activation of fault-indication enabler 96 and the supply of a measurement-enable signal to fault-detector gate 98 to permit display of a need-for-maintenance indication from window comparitor 88, if any, enabler 96 withdraws the measurement-enable signal and again monitors flame-on comparitor 94. If flame-on comparitor 94 remains up, indicating the continuing presence of burner flame 18, enabler 96 initiates a subsequent review interval of, preferably, five to seven minutes. As will be appreciated, this facilitates monitoring of the flame over heating cycles of long duration. While the number of reviews can be set as desired, to, in effect, vary the total review time in multiples of the stabilization interval, in preferred form, the cycling of enabler 96 is continuous until flame-on comparitor indicates flame 18 is no longer present.

Continuing with reference to FIG. 7, when an out-of-range measurement from window comparitor 88 is passed through fault-detector gate 98, it constitutes a need-for-maintenance signal and is passed to display, fault latch 100. Thereafter, fault latch 100 passes the need-for-maintenance signal to indicator drive 102 which in turn activates maintenance indicator 50. As noted, in preferred form, latch 100 retains the need-for-maintenance signal; i.e., fault indication, until latch 100 is physically reset at 52. This assures the burner user will be advised of the condition. As will be appreciated, the manual reset also acts a system check since it allows the user to retry the system following a fault indication to see if the fault will reappear, thereby confirming the degraded condition of the burner. As also noted, display elements 76 may include maintenance-indication takeoff 104, preferably in the form of a local printer to establish a permanent record of the fault, a communication device such as a modem for communicating the need-for-maintenance indication to a remote site such as a burner service company, and/or an alarm, etc.

In preferred form, to simplify construction and operation, on activation of maintenance indicator 50, power for normal-operation indicator 48 provided at power supply 106 is maintained, thus avoiding need for normal indication interrupt circuitry. Ambiguity in the presence of both normal operation lamp activation and fault operation lamp activation is avoided by advising the user; as for example, with a notice at display panel 44, that activation of the maintenance indicator on any occasion is an indication of need for maintenance.

Figure 8:
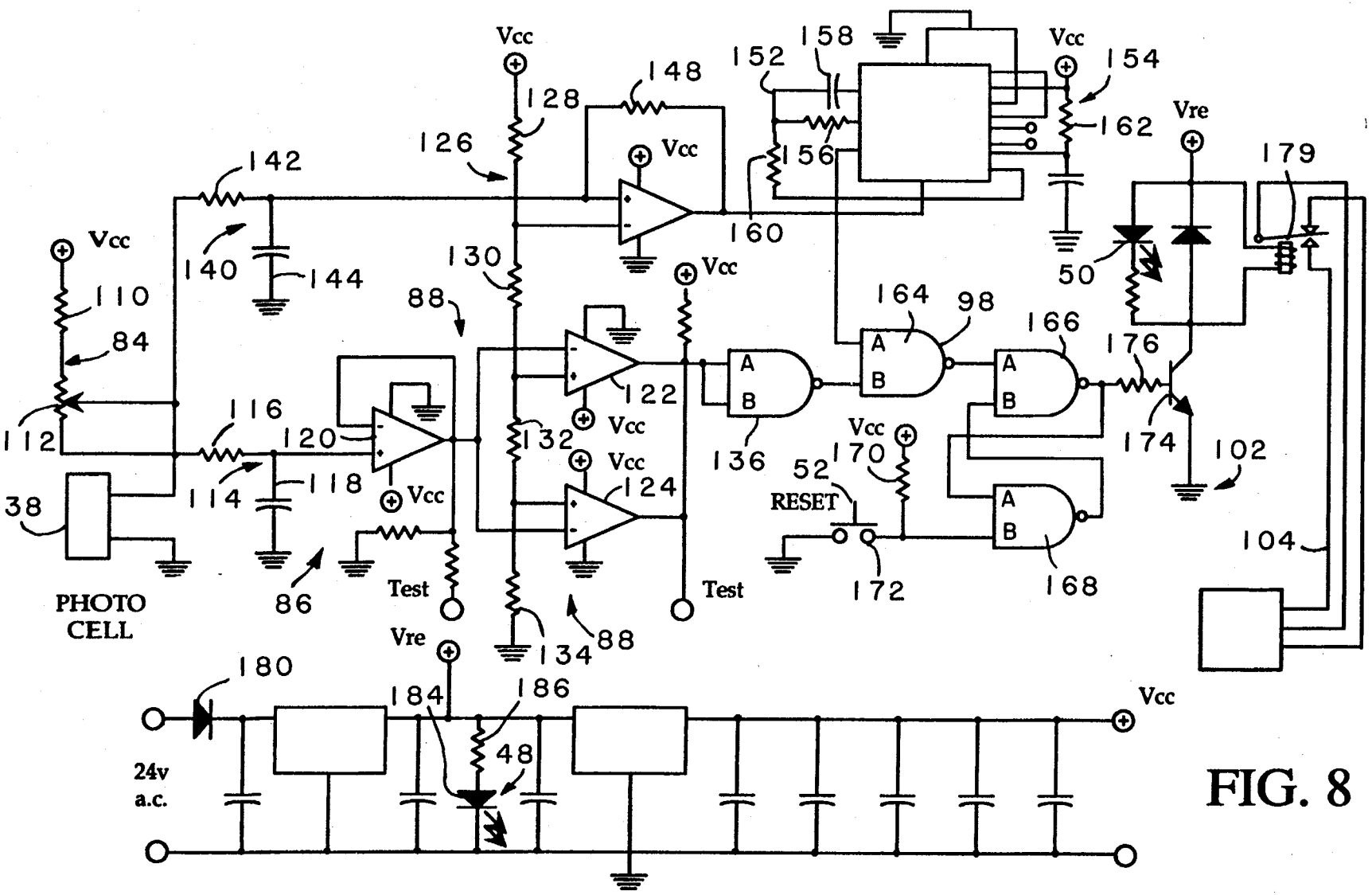
FIG. 8 is an electrical, schematic diagram of the improved oil-burner, flame-intensity monitoring system in accord with the invention.

As will be appreciated, while a number of specific implementation of the system shown in FIG. 7 might be undertaken, a preferred version is presented in FIG. 8. As seen there, photocell 38 is connected in series with a photocell bias network 84 formed as a variable voltage divider including d.c. voltage source Vcc in series with fixed resistor 110 and variable series resistor 112. Continuing, filter and amplifier stage 86 of comparitor elements 74 is seen to include a low-pass filter 114 comprising series resistor 116 and shunt capacitor 118, having its input connected to photocell 38. Filter and amplifier stage 86 is additionally seen to include an amplifier 120 formed by a differential amplifier 122 whose non-inverting input is connected to the output of filter 114, and whose inverting input is connected to its output.

As also shown in FIG. 8, window comparitor 88 includes a pair of differential comparators 122, 124, respectively, having their inverting inputs connected together and to the output of amplifier 120. Additionally, the respective non-inverting inputs of comparators 122 and 124 are, respectively, connected to a voltage divider 126 formed by a combination of resistors 128 to 132 connected in series between d.c. voltage source Vcc and ground so as to provide fixed reference voltage of different values to the respective non-inverting inputs of comparators 122 and 124. Continuing, window comparator 88 is also see to include NAND gate 136 having its inputs, A and B connected together and to the outputs of comparitors 122 and 124 and to voltage reference 138 formed by d.c. voltage source Vcc connected in series with resistance 139.

As also seen in FIG. 8, filter and flame-on comparitor 94 of measurement-enabling circuitry 90 contained in discriminator 78 outlined in FIG. 7 includes a low-pass filter 140 having a series resistor 142 and shunt capacitance 144, the input of filter 140 being connected to the input of filter 114 and to photocell 38. Further, filter and flame-on comparator 94 are seen to include differential comparator 146 having its non-inverting input connected to the output of low-pass filter 140. Additionally, the inverting input of comparitor 146 is seen to be connected to voltage divider 126 between resistors 128 and 130. Finally, the output of comparator 146 is feed back to the non-inverting input of comparator 146 thorough resistor 148 to provide stabilizing feed back for the typically slow rising input from photocell 38 in the presence of flame 18.

FIG. 8 also shows that fault-indication enabler 96 includes a clock 150 having an input connected to the output of flame-on comparator 146. Additionally, clock 150 is seen to include external timing circuits 152 and 154. Timing circuit 152 includes a parallel combination of resistor 156 and capacitor 158 connected in series with resistor 160. The values for resistors 156 and 160, and capacitor 160 are selected in conventional fashion to establish the stabilization interval above described; i.e., 5 minutes in preferred form. Circuit 154 includes resistor 162 connected in series with d.c. voltage source Vcc and is provided to supply the signal to gate 98 when the output from flame-on comparitor 146 indicative of a flame has been sustained for the interval defined by timing circuit 152. In preferred form, clock 150 is a conventional semiconductor, programmable timer as; for example a type 4536 supplied by Motorola under the number MC14536B.

Continuing with reference to FIG. 8, fault-detection gate 98 of discriminator 78 comprises a NAND gate 164. As shown, input A of NAND gate 164 is connected to the output of clock 150 and input B of gate 164 is connected to the output of NAND gate 136 of window comparitor 88. Still further, latch 100 of display elements 76 is seen to include a pair of NAND gates 166 and 168, respectively having their inputs and outputs connected in a such manner that a signal supplied to input A of gate 166 is retained at the output of gate 166 until input B of gate 168 is changed; i.e., reset. More specifically, input A of gate 166 is connected to the output of gate 164, while input B of gate 166 is connected to the output of gate 168. Further, input A of gate 168 is connected to the output of gate 166, and input B of gate 168 is connected to a reference voltage established by d.c. voltage Vcc in series with resistor 170. As also shown, reset 52 in the form of a manual switch 172 connected between input B of gate 168 and ground enables latch 100 to be cleared as desired by simply closing switch 172.

As also seen in FIG. 8, maintenance-indicator driver 102 comprises transistor switch 174 having its base input connected thorough resistor 176 to the output of latch NAND gate 166. Further, maintenance indicator 50 is seen to include a light emitting diode (LED) 178 connected between d.c. voltage source Vre and the collector of driver transistor switch 174, indicator diode 178 being oriented for activation on closing; i.e., conduction, of transistor switch 174, switch 14 being oriented in common emitter configuration.

Continuing, in preferred form, a relay activation coil is arranged in parallel with maintenance indicator diode 178 so that on activation of LED 178, the relay will change states, enabling, for example, activation of an optional local recorder and/or a communication facility such as a modem, etc.

Finally, in conventional fashion, power supply 106 is seen to include a half-wave rectifier 180 connected to a filter and regulating ladder network 182 for establishing two d.c. voltages Vre at +24 volts d.c. and Vcc at +5 volts respectively. As shown, power supply 106 is arrange to be feed by a 24 volt a.c. power pack. As also seen in FIG. 8, normal burner operation indicator 48 comprises a light emitting diode (LED) 184 connected in series with d.c. voltage source Vre and resistor 186 for continuous activation when a.c. power is supplied to the system; i.e., when it is turned on.

Figure 6:
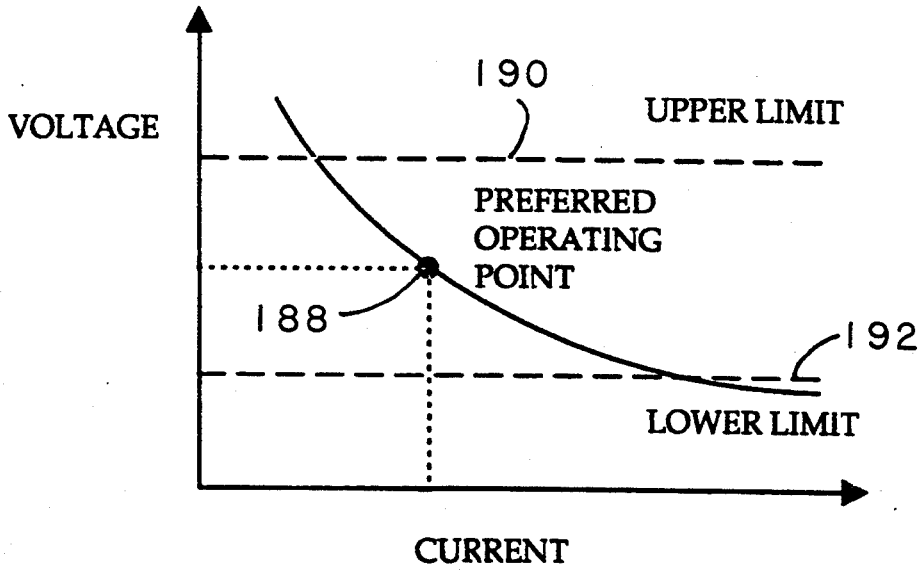
FIG. 6 is a generalized plot of photocell voltage and current which depicts the setting of the photocell operating point for the improved flame intensity monitoring system in accord with the invention.

With regard to operation, to setup system 1, variable resistor 112 of bias network 84 is adjusted to establish a voltage and current operating point for photocell 38. As best seen in FIG. 6, operating point 188 is set to lie approximately midway between upper and lower voltage level 190 and 192 respectively, upper and lower voltage levels 190 and 192 being selected for the range of flame intensities considered to represent the maximum allowable smoke content for the burner. As will be appreciated by those skilled in the art, since burner flame-light intensity typically has a peak at an excess air value of approximately 15%, if the system were adjusted to that excess air value, comparitor 88 would have to only monitor a minimum level; i.e., include a single differential comparitor set to the minimum acceptable light level. However, as is well known in the art, burners are typically set at excess air settings above the value for peak light intensity; for example, approximately 25 to 40 depending on the burner type, to allow for other factors relating to burner operation. Accordingly, comparitor 88 includes two compaitor elements, respectively set to an upper and lower limit of the preferred operating range. In this regard, the upper and lower voltage limits for photocell 38; i.e., permissible flame intensity window, are adjusted by connecting the voltages provided at voltage divider 126 to the non-inverting inputs of differential comparitors 122 and 124. As will be appreciated, in setting bias point 188, photocell 38 is subjected to a preferred burner flame.

Following setup, system 1 is ready for operation. On ignition of burner 4 and generation of flame 18, photocell 38 provides a signal at the inputs to low-pass filters 114 and 140. Filters 114 and 140 are identical and act to remove signal variation arising from fluctuation of burner flame 18. Considering operation of comparitor elements 74 first. On emergence for filter 114, the photocell flame intensity signal is boosted in amplitude at amplifier 120 for subsequent measurement. Thereafter, the filtered and amplitude-enhanced flame intensity signal is provided to differential comparators 122 and 124 of window comparator 88. Where the photocell flame intensity signal lies within the acceptable limits of the window, the output of the respective comparators remains low, the photocell signal being less that the maximum permissible signal set by comparator 122 and more that the minimum permissible signal set at comparitor 124. As a result, absent an out-of-limit measurement at either comparitor 122 or 124, the input to NAND gate 136 of window comparitor 88 remains high and the output low. Accordingly, the signal presented to input B of NAND gate 164 remains low, and no indication of need for service is provided.

If, however, the photocell flame intensity signal were to either exceed the maximum permissible level or fall below the minimum permissible level, the output of either comparitor 122 or 124 would go down, and with it the input to NAND gate 136, thus, causing the output of gate 136 to go up. However, since the output of window comparitor 88 is presented to another NAND gate; i.e., the B input to gate 164, absent an indication at the A input to gate 164, the output gate 164 can not change from the high state; i.e., no call for maintenance. As noted, above discriminator 78 controls whether an out-of-range signal is advanced for display.

In that regard, as the photocell flame intensity signal is presented to comparator 74 it is likewise presented to discriminator 78, specifically low-pass filter 140. On emerging for filter 140, it is passed to differential comparitor 146 of flame-on comparator 94. Where the photocell intensity signal was insufficient to satisfy the reference level set at comparitor 146 by voltage divider 126, no signal would be provided at the output the flame-on comparator and clock 150 of fault-indication enabler could not be activated and as a result no measurement enable signal could be provided. The result of this would be the out-of-range signal from window comparator 88 would be discriminated against and disregarded.

If, however, the photocell light intensity signal was adequate to satisfy flame-on comparator 94, the output of comparator 94 would go up and activate clock 150. But, if the duration of the flame was less that the interval measured by clock 150 timing circuit 152; i.e., if the flame duration was too short, clock 150 again would not provide a measurement-enabling signal to gate 164 and the window comparator signal would be disregarded, On the other hand, if the photocell flame intensity signal sustained for the requisite interval, preferably five to seven minutes, flame-on comparator 94 would facilitate clock 150 generating the measurement-enable signal at circuit 154 necessary to gate the window comparator out-or-range signal through gate 98. Specifically, where both inputs A and B of NAND gate 98 are up, its output goes low. Subsequently, the driving of gate 164 output low causes the input A to latch NAND gate 166 to go low and its output to go high. And, once the output of gate 166 goes high, driver transistor switch 174 activates maintenance LED 178. As noted above, on activation of the maintenance LED, the maintenance indication takeoff is likewise activated by action of relay 179.

Following the activation of maintenance LED 178, latch NAND gate 166 remains high because both inputs to gate 168 remain high, causing the output of gate 168 to go low, which, in turn, holds input B of gate 166 low, thus sustaining the output of NAND gate 166 high. To interrupt this arrangement, the B input of gate 168 must be forced low by manually closing reset switch 172. As will be appreciated, on returning latch 100 to the low state, the maintenance-indicator driver is turned off and with it so to is LED 178. As will also be appreciated, on deactivating LED 178, relay 179 is cycled, and diode 181 controls decay of the relay coil.

With regard to the method aspect of the invention, the method features steps for: sensing burner flame light intensity; comparing sensed flame light intensity to predetermined range limits; selectively coupling out-of-range intensity measurements to a display; and indicating the need for burner maintenance. In this regard, method steps for selectively coupling out-of-range measurements to the maintenance indicator include steps for discriminating the flame intensity by comparing sensed flame intensity to a flame-ignition reference for generating an ignition-verification signal. In addition, the discriminating procedure further include steps for monitoring the ignition-verification signal over a predetermined time interval and where the verification signal is sustained for the prescribed interval, an indication-enabling signal is generated. In preferred form, the discriminating procedures includes steps for indicating out-of-range flame intensities only when an out-of-range measurement and an indication-enabling signal are present.

Additionally, the method aspect of the invention optionally includes steps for either locally recording indications of need for burner maintenance or communicating such indications to a burner-service company, as for example, by modem and/or activating an alarm. Still further, the method features steps for storing the indications of need for maintenance and requiring such stored indications be physically cleared by an operator to assure notification of burner's need for maintenance.

While we have described our invention in preferred form, it will be appreciated by those skilled in the art that various changes in form, construction and arrangements of its elements may be made without departing from spirit or scope of the invention.

What we claim is:

1. In apparatus for monitoring the light intensity of a burner flame, the apparatus including means for sensing light intensity of the burner flame and generating signals corresponding to the flame-light intensity; comparator means responsive to the sensing means for comparing the signals corresponding to the sensed light intensity to a predetermined reference and providing an out-of-range signal when the signal corresponding to the sensed light differs from the reference in a predetermined manner; and means responsive to comparator means for indicating when the out-of-range signals arise, the improvement comprising:

further including discriminator means responsive to the sensor means for determining when an out-of-range signal is indicated.

2. The apparatus of claim 1 wherein the discriminator means determines when to indicate an out-of-range signal based on a characteristic of the burner flame.

3. The apparatus of claim 2 wherein the discriminator means determines when to indicate an out-of-range signal based on the duration of the burner flame.

4. The apparatus of claim 3 wherein the discriminator means determines when to indicate an out-of-range signal based on the amplitude and duration of the burner flame.

5. The apparatus of claim 4 wherein the discriminator means determines when to indicate an out-of-range signal based on the stabilization of the burner flame following ignition.

6. The apparatus of claim 4 wherein the discriminator means includes means for generating an indication-enabling signal and gate means responsive to the means for generating the indication-enabling signal and the comparitor means.

7. The apparatus of claim 6 wherein the means for generating an indication-enabling signal includes a clock.

8. The apparatus of claim 7 wherein the discriminator means includes means for determining whether the burner flame is ignited before attempting to generate an indication-enabling signal.

9. The apparatus of claim 8 wherein the discriminator means generates multiple, indication-enabling signals during the interval the burner flame is ignited.

10. The apparatus of claim 9 wherein the discriminator means includes means for filtering the sensor signals corresponding to the flame light intensity signals.

11. In a method for monitoring the light intensity of an ignited burner flame, the method including steps for sensing light intensity of the burner flame and generating signals corresponding to the flame-light intensity; steps for comparing the signals corresponding to the sensed light intensity to a predetermined reference and providing an out-of-range signal when the signal corresponding to the sensed light differs from the reference in a predetermined manner; and indicating when the out-of-range signals arise, the improvement comprising:

further including steps for selectively indicating when out-of-range, light-intensity signals arise.

12. The method of claim 11 wherein the steps for selectively indicating when out-of-range intensity signals arise includes discriminating between flame intensity signals by determining when the flame has substantially thermally stabilized and thereafter generating an indication-enabling signal.

13. The method of claim 12 wherein determining when the flame has substantially stabilized includes monitoring the presence of the flame over a predetermined time interval.

14. The method of claim 13 wherein discriminating additionally includes comparing sensed flame-light intensity to a predetermined flame-ignition reference.

15. The method of claim 14 wherein discriminating includes indicating out-of-range, flame-light intensities signals only when an out-of-range, flame-light intensity signal and an indication-enabling signal are present.

16. The method of claim 15 further including steps for recording indications of out-of-range, flame-light intensity signals.

17. The method of claim 15 further including steps for transmitting indications of out-of-range, flame-light intensity signals to a remote site.

18. The method of claim 15 further including steps for activating an alarm when indications of out-of-range, flame-light intensity signals arise.

* * * * *

US005424554B1

(12) REEXAMINATION CERTIFICATE (4426th)

United States Patent

Marran et al.

(10) Number: US 5,424,554 C1

(45) Certificate Issued: Aug. 28, 2001

(54) OIL-BURNER, FLAME-INTENSITY, MONITORING SYSTEM AND METHOD OF OPERATION WITH AN OUT OF RANGE SIGNAL DISCRIMINATOR

(75) Inventors: John D. Marran, Califon, NJ (US); Stanley Miller, Rocky Point, NY (US)

(73) Assignee: Energy Kenitics, Inc., Lebanon, NJ (US)

Reexamination Request:
No. 90/005,446, Aug. 10, 1999

Reexamination Certificate for:

| | |
|---|---|
| Patent No.: | **5,424,554** |
| Issued: | **Jun. 13, 1995** |
| Appl. No.: | **08/216,147** |
| Filed: | **Mar. 22, 1994** |

(51) Int. Cl.[7] ..... G01J 1/10

(52) U.S. Cl. ..... 250/554; 340/578

(58) Field of Search ..... 250/554, 239; 340/577, 578; 356/218, 226, 438

(56) References Cited

U.S. PATENT DOCUMENTS

| | | | |
|---|---|---|---|
| 3,903,418 | 9/1975 | Horn | 250/338.1 |
| 3,940,753 | 2/1976 | Muller | 250/338.1 |
| 4,575,333 | 3/1986 | Bryant | 431/18 |
| 4,882,573 | 11/1989 | Leonard et al. | 340/578 |
| 4,904,986 | 2/1990 | Pinckaers | 340/578 |
| 5,126,721 | 6/1992 | Butcher | 250/554 |
| 5,236,328 | 8/1993 | Tate et al. | 431/14 |
| 5,365,223 | 11/1994 | Sigafus | 340/578 |

OTHER PUBLICATIONS

Underwriters Laboratories Inc., Standard for Safety, *Standard for Primary Safety Controls for Gas–And–Oil–Fired Appliances UL372,* Sep. 12, 1985, pp. 1–47.

T. Butcher, Project Report, *Performance Control Strategies for Oil–Fired Residential Heating Systems,* Jul. 1990, pp. 73, 76–78, 82–83, 96–98.

European Standard No. 23, *Monobloc oil burners—Safety, Control and Regulation Devices and Safety Times,* Nov. 1990, pp. 1–28.

European Standard No. 298, *Safety and Control Devices for Gas–Burners and Gas–Burning Applicances,* 1993, pp. 1–44 (Month unknown).

*Primary Examiner*—Que Le

(57) ABSTRACT

Improved apparatus and method for selectively monitoring the light intensity emitted from an oil-burner flame for purposes of determining when the burner is in need of preventative maintenance. The apparatus features a monitoring system including: a sensor for detecting burner, flame-light intensity; a comparator for comparing the light intensity sensed to predetermined upper and lower limits; a display for indicating whether the burner is operating acceptably or whether it requires maintenance; and a discriminator for selectively coupling out-of-range, intensity indications representative of a need for maintenance to the display. The discriminator includes measurement-threshold circuitry for determining whether the burner has successfully ignited and whether the flame generated has been sustained long enough to assure thermal stabilization. Additionally, the discriminator includes gating circuitry for passing out-or-range, intensity measurements to the display elements only when predetermined, measurement-threshold conditions have been satisfied. The method features steps for: continuously sensing burner, flame-light intensity; comparing sensed, flame-light intensity to predetermined range limits; and selectively coupling out-of-range, intensity indications to a display for indicating the need for burner maintenance.

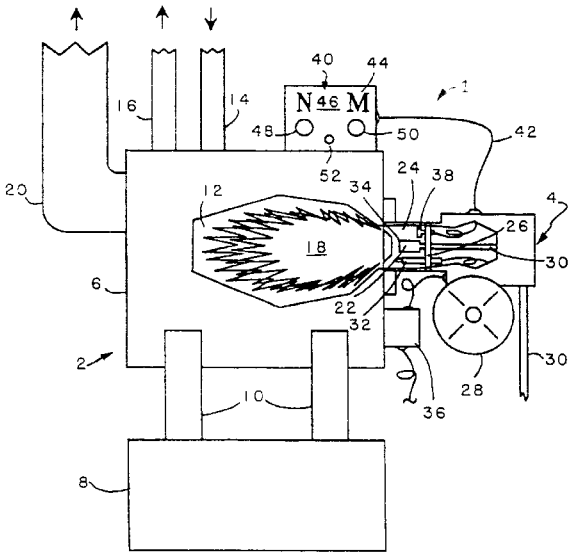

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–18 are cancelled.

* * * * *